US006718748B1

(12) United States Patent
Patterson

(10) Patent No.: US 6,718,748 B1
(45) Date of Patent: Apr. 13, 2004

(54) YARN COVERING APPARATUS AND METHOD

(75) Inventor: Thomas Leslie Patterson, Eglington (GB)

(73) Assignee: Adria Limited, Eglinton (GB)

( * ) Notice: Subject to any disclaimer, the term of this patent is extended or adjusted under 35 U.S.C. 154(b) by 0 days.

(21) Appl. No.: 09/869,456

(22) PCT Filed: Nov. 30, 1999

(86) PCT No.: PCT/GB99/03977

§ 371 (c)(1),
(2), (4) Date: Dec. 6, 2001

(87) PCT Pub. No.: WO00/39375

PCT Pub. Date: Jul. 6, 2000

(30) Foreign Application Priority Data

Dec. 23, 1998 (GB) ..... 9828291

(51) Int. Cl.[7] ..... D01H 1/10

(52) U.S. Cl. ..... 57/58.55; 57/3; 57/13; 57/58.61; 57/58.83

(58) Field of Search ..... 57/3, 12, 13, 14, 57/15, 16, 17, 18, 58.55, 58.61, 58.83, 58.84

(56) References Cited

U.S. PATENT DOCUMENTS

| | | | | |
|---|---|---|---|---|
| 2,737,773 A | | 3/1956 | Clarkson | |
| 2,782,590 A | * | 2/1957 | Lowe | 57/58.52 |
| 3,683,607 A | | 8/1972 | Chatin | |
| 3,834,143 A | | 9/1974 | Menegatto | |
| 4,125,992 A | | 11/1978 | Kallmann | |
| 4,232,507 A | | 11/1980 | Northup et al. | |
| 5,303,550 A | | 4/1994 | Setzer | |
| 6,098,392 A | * | 8/2000 | Tung | 57/14 |

FOREIGN PATENT DOCUMENTS

| | | |
|---|---|---|
| EP | 0 091 272 | 10/1983 |
| EP | 0 310 848 | 4/1989 |
| EP | 0 551 787 | 7/1993 |
| GB | 338570 | 11/1930 |
| GB | 361373 | 11/1931 |
| GB | 1 590 020 | 5/1981 |
| GB | 2345049 A | 6/2000 |
| TW | 6910244 | 11/1928 |
| TW | 74207153 | 3/1929 |
| WO | WO 92/05302 | 4/1992 |

* cited by examiner

*Primary Examiner*—John J. Calvert
*Assistant Examiner*—Shaun R Hurley
(74) *Attorney, Agent, or Firm*—Adams Evans P.A.

(57) ABSTRACT

A method of covering a core yam with a cover yarn characterised in that it includes supplying a package of core yam on a member which is fixed against rotation, supplying a package of cover yam, guiding the cover yarn to form a loop which on rotation about an axis defines an envelope which surrounds the core yarn package, drawing off core yarn along the axis of rotation of the envelope in the direction away from the cover package so that when the core yarn intercepts the envelope it is covered by cover yarn.

23 Claims, 5 Drawing Sheets

YARN COVERING APPARATUS AND METHOD

CROSS-REFERENCE TO RELATED APPLICATIONS

This application is a national stage application, according to Chapter II of the Patent Cooperation Treaty.

This is a filing of a national phase PCT application in the United States originating from PCT Application No. PCT/GB99/03977 filed Nov. 30, 1999 which claimed priority from United Kingdom Patent Application No. 9828291.6 filed Dec. 23, 1998.

BACKGROUND OF THE INVENTION

The present invention concerns improvements in or relating to apparatus and methods for winding a cover yarn or yams around a core yarn. The method and apparatus especially, but not exclusively, is concerned with yarns ultimately to be knitted into hosiery, for example ladies stockings and tights.

U.S. Pat. No. 3,834,143 discloses a method and apparatus for covering a core yarn, in which a cover yarn is wound around the core yarn.

The relatively small diameter of the core and covering yarns and the relative fragility of the yams gives rise to certain difficulties. Prior apparatus and methods have overcome some of these difficulties but certain disadvantages remain.

In one presently accepted apparatus, cover yarn is prewound on to a specially shaped, doubled flanged bobbin which is mounted on a hollow spindle positioned between a core yarn supply and a core yarn take-up with the core yarn passing through the hollow spindle. Cover yarn is wound around the core yarn after it has passed through the hollow spindle by rotating the flanged bobbin. The maximum rotational speed of the bobbin is restricted by virtue of its mass and dimensions and this means that only a limited amount of cover yarn can be wound on to the core yarn if it is to achieve an acceptable rotational speed. The relatively small amount of cover yarn on the bobbin means that the apparatus has to be stopped frequently to change bobbins. The length of covered yarn taken up on the core yarn take-up is relatively short and, in practical terms, perhaps a quarter of the length of yarn normally carried by the yarn spools utilised on commercial knitting machines. To provide a spool of yarn for a commercial knitting machine it is therefore preferable to rewind the covered core yarn from several yarn take-up spools. Normally the contents of at least four take-up spools are wound onto the knitting machine package and this means that, in addition to the inconvenience of providing re-spooling machinery, providing man power to operate this re-spooling machinery and the replacement of bobbins in the covering machinery, the yarn supplied to the knitting machine includes knots at the joints between lengths.

SUMMARY OF THE INVENTION

According to one aspect of the present invention there is provided a method of covering a core yarn with a cover yarn comprising supplying a package of core yarn on a member which is fixed against rotation, supplying a package of cover yarn, guiding the cover yarn to form a loop which on rotation about an axis defines an envelope which surrounds the core yarn package, drawing off core yarn along the auras of rotation of the envelope in the direction away from the cover package so that when the core yarn intercepts the envelope it is covered by cover yarn.

Preferably a plurality of cover yarns are provided to form a multiple covering on the core, yarn, each cover yarn being taken from an independent supply of cover yarn, all of which are arranged in sequence on one side of the core yarn supply, the cover yarn from each supply being guided to form a loop which on rotation about an axis defines an envelope which surrounds the core yarn supply and all cover yarn supplies which are closer to the core yarn supply than the said cover yarn supply.

The loops are spaced from each other and rotated at the same speed and in the same direction.

Preferably all cover yarn envelopes are intercepted by the core yarn at the same point or closely spaced points. Preferably the loops which define all the envelopes are equally spaced angularly at the interception point.

According to a second aspect of the present invention there is provided apparatus for covering a core yarn comprising a mounting for a package of core yarn fixed against rotation, a first rotatable member located on one side of the core yarn package and a second rotatable member located on the other side of the core yarn package, the rotatable members being axially spaced from the core yarn package, means for rotating the first and second rotatable members at the same speed and direction, a mounting for a package of cover yarn, take-off means for leading cover yarn from said cover yarn package to the centre of said first rotatable member, first guide means in or on the first rotatable member for guiding cover yarn from the centre to or near to the periphery of said first rotatable member, second guide means in the first rotatable member for leading cover yarn from the first rotatable member to or near to the periphery of the second rotatable member, guide means in or on the second rotatable member for guiding cover yarn from or near to the periphery of the second rotatable member to the centre of the said rotatable member, core yarn take-off means for leading core yarn through the second rotatable member along its axis of rotation whereby cover yarn exiting from the second rotatable member at its centre is wound around the core yarn, and means for drawing off covered yarn.

Preferably the rotatable members are discs.

Preferably the mounting for the cover yarn package is fixed against rotation.

Preferably the guide means for the cover yarn in or on the second disc includes a guide closely adjacent to the aids of rotation of the disc such that cover yarn is wound around the core yarn from a direction generally perpendicular thereto.

Preferably the means for holding the core yarn packaging against rotation includes a magnet in the core yarn mounting and a magnet on a fixed member located on the side of the second disc opposite to said core yarn mounting.

Preferably a hollow member passes through the core yarn package through which core yarn from the package is guided to the centre of the second disc.

Preferably a yarn tensioner is provided for the core yarn.

Preferably the tensioner comprises first and second annular discs mounted for axial movement over the surface of the hollow member, a spring for biasing discs towards the end of the hollow member and an annular member resting on the disc closest to the end of the member, the weight of said annual member being variable to vary tension on yarn passing between the discs prior to it passing through the spindle.

Preferably the axes of the cover yarn package, the first and second disc and the core yarn package are coincident.

Preferably a cylindrical enclosure is provided around a pair of co-operating discs and the core yarn package, extending between members located on the sides of the discs remote from the core yarn package.

Preferably one or more additional cover yarn packages are interposed between the said cover yarn package and the core yarn package, each of said interposed packages having a pair of discs on each side thereof, with each disc being provided with cover yarn guide means for directing cover yarn from preceding package(s) from the centre to the periphery of the upper disc of the pair, from the periphery of the upper disc to the periphery of the lower disc, from the peripheral of the lower disc to the centre thereof and thereafter to the centre of the next succeeding discs with all the discs being rotated at the same speed and in the same direction.

Preferably each disc has guide paths for each cover yarn passing across the disc.

Preferably said paths are angularly equispaced.

Alternatively the apparatus includes a further mounting for a package of second cover yarn, means for holding the further mounting against rotation, third and fourth discs located on each side of the said mounting and package, means to rotate the third and fourth discs at the same speed and in the same direction, means for leading covered yarn from an earlier covering apparatus to the centre of the third disc, guide means in or on the third disc for guiding covered yarn from the centre to or near to the periphery of the third disc, means at or near the periphery of the third disc for guiding covered yarn to a point at or near the periphery of the fourth disc, guide means in or on the fourth disc for guiding covered yarn from its periphery to its centre, and further guide means for guiding covered yarn through the centre of the fourth disc whereby the second cover yarn and the covered yarn are wound together and means for drawing off covered yarn.

Preferably the guide passages are formed through each disc. Alternatively, they may be formed over a surface of the disc.

Preferably yarn guides are located at the ends of each passage, the yarn guides being formed from a hard wearing material, for example a ceramic material. Preferably yarn guides are mounted at a position spaced internally from the periphery of the disc.

According to a further aspect of the present invention there is provided a method of covering a core yarn with a cover yarn comprising removing core yarn from a package of core yarn fixed against rotation, drawing the core yarn through a hollow member, rotating first and second discs at the same speed, about the axis of said spindle with the discs spaced on either side of the core yarn package, supplying a cover yarn to the centre of the first disc, leading the cover yarn from the centre of the first disc to its periphery, then to the periphery of the second disc, then from the periphery of the second disc to the centre of the second disc, guiding core yarn through the centre of the second disc along the axis if rotation thereof, winding cover yarn around the core yarn and drawing off the covered core yarn.

A further aspect of the present invention provides a method for producing covered yarn in which a cover yarn is tensioned and guided radically away from the axis of a core yarn package, axially alongside the core yarn package and thereafter radially towards the axis of the core yarn package while being rotated about the said axis, core yarn being drawn off its package and along said axis whereby the cover yarn is wound around the care yarn after being guided towards it.

According to a still further aspect of the present invention there is provided a yarn tensioner comprising generally vertical hollow member, first and second discs mounted for axial movement along the member and adapted to receive the yarn to be tensioned therebetween, biasing means for urging the discs towards the top of the hollow member and an adjustable weight located on the upper disc.

Preferably the yarn is guided radially from the outside to the inside of the discs and thereafter along the hallow member to and over its top.

Another aspect of the present invention provides an enclosure for a yarn covering apparatus comprising a cylindrical member adapted to be arranged in an apparatus in which a loop of covering yarn is caused to rotate about a core yarn to be covered coaxial with and around the rotating loop of cover yarn and means for causing a rotational movement of the air within the enclosure in the same direction as the rotation of the loop and at a speed no greater than the loop speed.

Preferably the same means rotate the loop and the air.

BRIEF DESCRIPTION OF THE DRAWINGS

Embodiments of the present invention will now be described by way of example only with reference to the accompanying drawings in which.

DETAILED DESCRIPTION OF THE INVENTION

Figure 1:
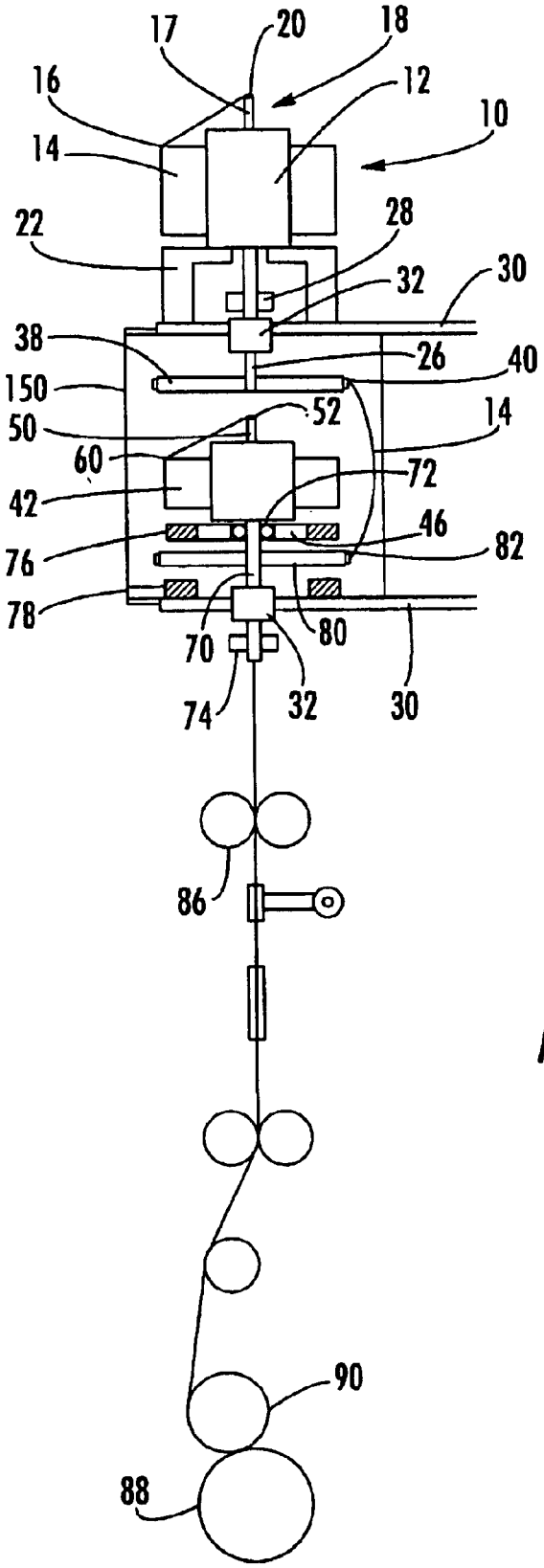
FIG. 1 shows an apparatus for providing a single yarn covering on a core yarn.

A package 10 of cover yarn comprises a standard cylindrical spool 12 which has no end flanges and on which is wound, in a helical path, a cover yarn 14, the yarn removal point 16 being at the outer periphery of the package. The cover yarn package 10 is mounted by any convenient means about a central yarn tensioner assembly 18 which is coaxial with the axis of the package 10 and has a yarn tensioner 20 at its end. A mounting means 22 supports the cover package 10 against rotation and is in turn fixed to a mounting member 30 of the framework of the apparatus. A bearing 32 is mounted by the member 30 and rotatably supports a spindle 26 which is coaxial with the yarn tensioner assembly 18, is hollow and communicates with a hollow member 17 of the yarn tensioner assembly 18. The spindle 26 has a toothed drive wheel 28 fixed thereto and around which a toothed drive belt (not shown) is passed, the drive belt being driven by an electric motor (not shown) mounted to the framework member 30.

A first disc 38 manufactured from a suitable plastics material is mounted to the lower end of the rotatable spindle 26. A yarn passage (not shown) is formed in a radial direction from the periphery of the first disc 38 to its centre, communicating with the hollow centre of the spindle 26. Ceramic yarn guides are provided at each of the yarn passage to guide cover yarn taken from the package removal point 16, by way of the tensioner 20 and through the coaxial, hollow member 17 and spindle 26, to the yarn guide adjacent the centre of the first disc 38, and through the radial passageway to the yarn guide 40 mounted at or near the periphery of the disc.

Figure 4:
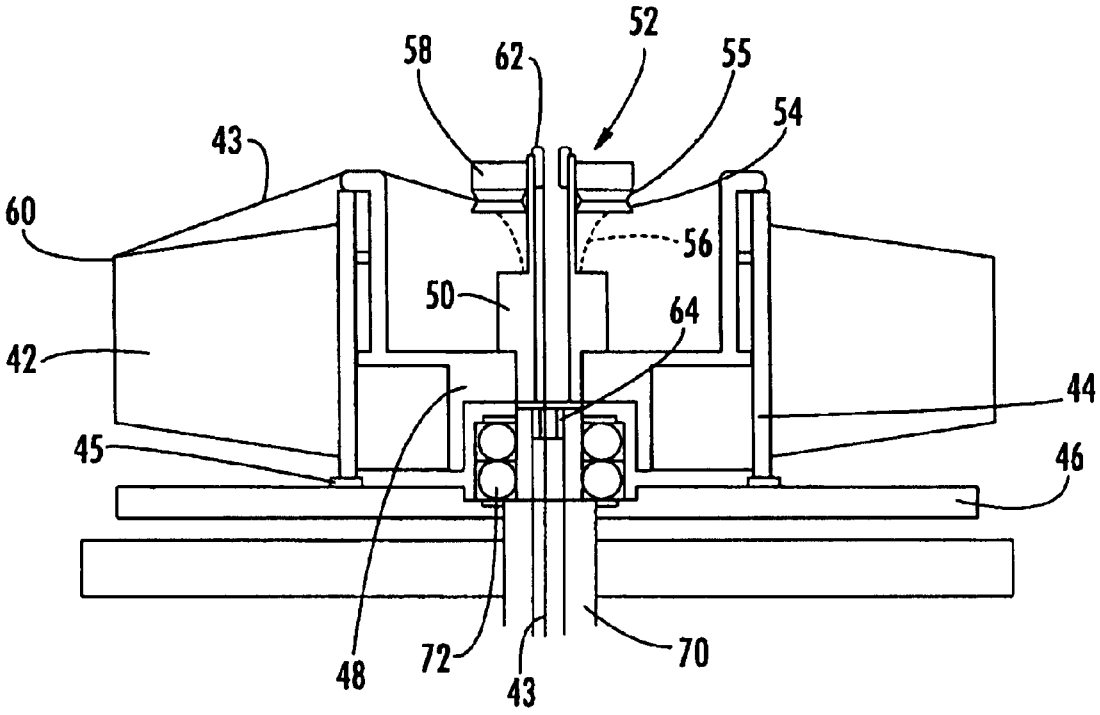
FIG. 4 shows a detail of the mounting of a yarn package of the apparatus of FIGS. 1, 2 and 3.

A mounting arrangement is provided for a package 42 of core yarn. Core yarn package 42 is more clearly illustrated in FIG. 4 and comprises a non-flanged cylindrical bobbin 44 having core yarn 43, which is normally an elastic yarn, for example LYCRA (Registered Trade Mark), wound thereon in a normal helical arrangement. The bobbin 44 is mounted on a mounting plate 46 by a bobbin mounting assembly 48. The assembly includes a plurality of angularly spaced resilient members 45 having a serrated upper surface, the members 45 preventing any tendency for the bobbin to move over the mounting plate as yarn is drawn off the bobbin. The assembly 48 includes also a hollow member 50 carrying a yarn tensioner 52 at its upper end. The yarn tensioner 52 comprises a first ceramic disc mounted for axial movement over the outer surface of the member 50 and spring biased towards the upper end of the member by a coil spring 56. A second ceramic disc 55 is also mounted for axial movement along the end of the member 50. Core yarn taken from a take-up point 60 on the periphery of yarn package 42 is led between the discs 54 and 55 up the outer wall of the member 50, over an annular ceramic guide 62 fixed at the top of the member 50 and down through the member 50 to a guide 64. It will be realised that the coil spring 56 provides a shock absorbing effect to the yarn tensioner and tension in the yarn is determined by the weight on an annular member 58 resting on the top disc 55.

A rotatable hollow spindle 70, which is coaxial with the member 50, supports through a bearing 72, the mounting plate 46 and carries a toothed drive wheel 74 (FIG. 1) driven by a toothed belt (not shown) which in turn is driven by an electric motor mounted on the framework 30 of the machine. The motor drives the wheel 74 at exactly the same speed as the toothed wheel 28, this being most readily achieved by using a single output shaft from the electric motor to drive both toothed belts.

Magnets 76 on the mounting plate 46 are located by corresponding magnets 78 fixed to the machine frame work 30 to hold the core package and its mounting plate 46 against rotation. This enables a second plastics material disc 80 fixed to the hollow spindle 70 to rotate in the magnetic field between the magnets 76 and 78. The second disc 80 is of similar construction to the first disc 38 and includes a radial passageway (not shown) extending therethrough from a peripheral yarn guide 82 to a yarn guide 84 (FIG. 1*a*) at the centre of the disc 80. FIG. 1*a* shows that core yarn 42 is guided through the rotating spindle 70 and past the rotating yarn guide 84 as cover yarn 14 is wound therearound due to the rotation of the second disc 80.

Figure 1A:
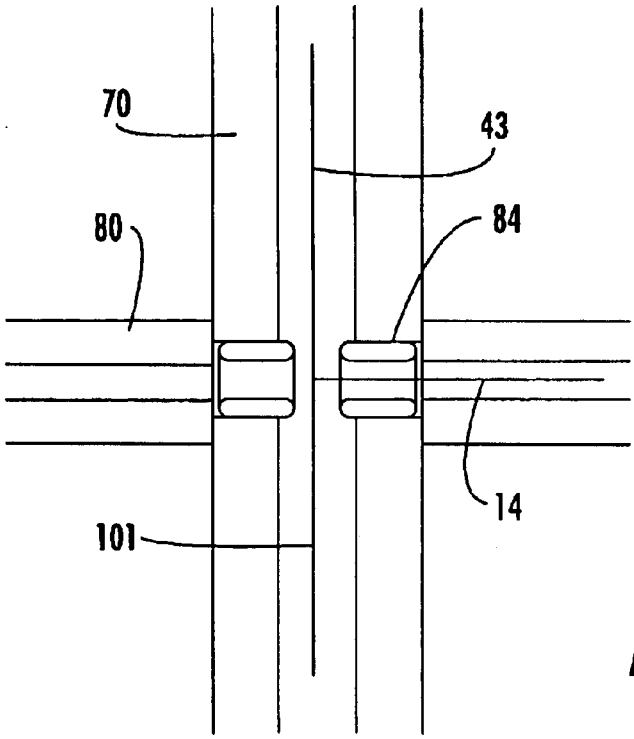
FIG. 1*a* shows a detail of the apparatus of FIG. 1.

FIG. 1 further shows that the cover yarn 14 is led from the yarn guide 40 at the periphery of the first disc to the yarn guide 82 at the periphery of the second disc which is rotating at exactly the same speed and in the same direction as the first disc. The cover yarn is therefore guided by the rotating discs around the fixed package of core yarn without any noticeable ballooning effect in the length of yarn between the guides 40 and 82.

Covered core yarn is removed by draw rollers 86 to a take-up package 88 driven in a known manner by a take-up drive roller 90. It will be realised that by adjusting the tension at the core yarn tensioner assembly 52 the degree of stretch in the core yarn is adjusted, that is the core yarn is stretched as it is covered with cover yarn.

It will be realised that as the discs 38 and 80 rotate at high speed the length of cover yarn 14 extending between them moves through the ambient air at high speed and is subject to undesirable drag. To obviate this problem a cylindrical enclosure 150 is constructed between the framework members 30 to provide a totally enclosed volume of air around the path of the cover yarn 14. This volume of air, on rotation of the discs 38, 80 will be induced to rotate thus reducing the drag effect. Additionally, the enclosure acts as a safety cage around the rotating components of the apparatus.

Figure 2A:
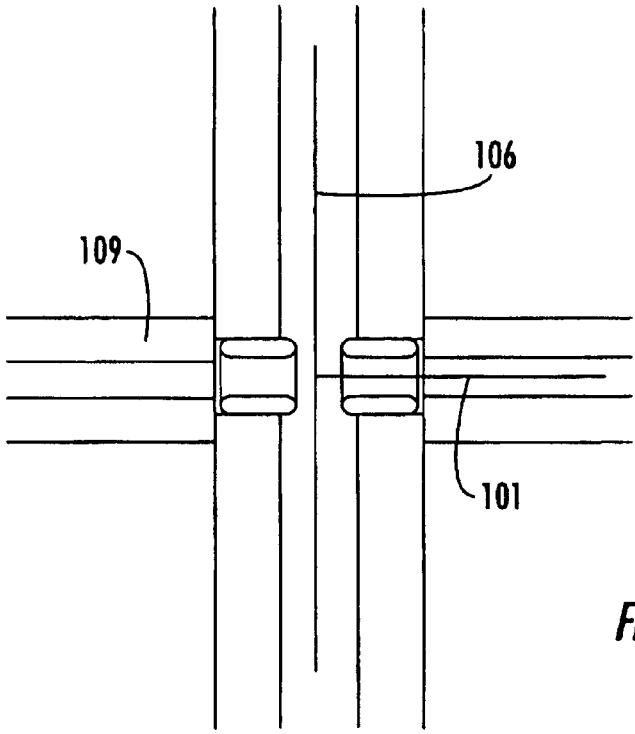
FIG. 2*a* shows a detail of the apparatus of FIG. 2.
Figure 2:
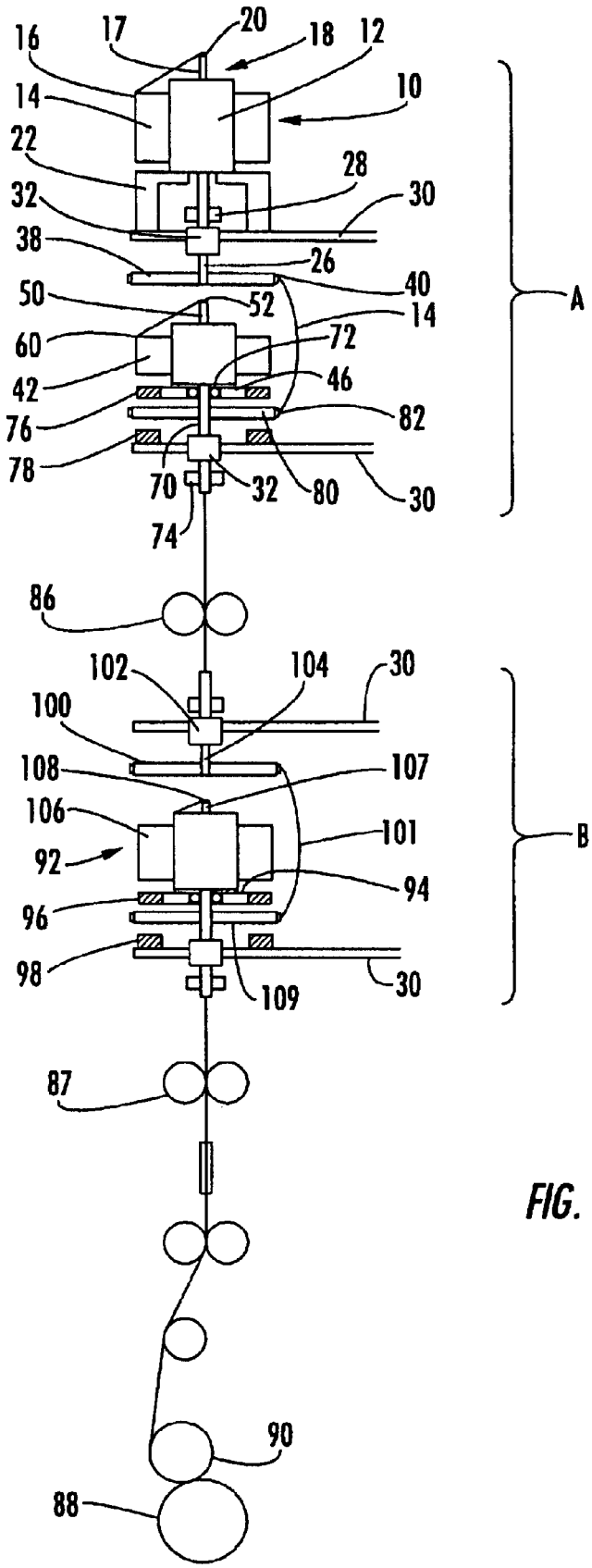
FIG. 2 shows diagrammatically an apparatus for providing a double yarn covering on a core yarn.

FIG. 2 shows an apparatus for applying two cover yarns to a core yarn. That part of the apparatus labelled "A" in FIG. 2 takes the form of the apparatus illustrated in FIG. 1 and will not be described in further detail. In this embodiment, the covered core yarn at the draw rollers 86, rather than being wound on a package, is passed through another covering apparatus section labelled "B" in FIG. 2. The section of the apparatus labelled "B" comprises a second package 92 of cover yarn which is mounted in a manner similar to that described with reference to FIG. 1 on a mounting place 94 which is held against rotation by magnets 96 on the mounting plate 94 which are located by magnets 98 on the framework 30 of the machine. A third disc 100 is mounted on a hollow rotatable spindle 104 through which the covered yarn 101 is passed and which is rotatably mounted by a bearing 102 on the machine framework 30. The disc 100 and spindle 104 are rotated, as before, by a toothed drive wheel and belt arrangement. The third disc 100 resembles the first and second discs 38, 80. The passageway in disc 100 guides the covered yarn 101 from the centre of the disc 100 to the yarn guide at its periphery. The second cover yarn is guided from the periphery of the package 92 to a yarn tensioner assembly 108 on the upper end of a member 107 of the mounting assembly for the second cover yarn. Thereafter it is guided down through the member 107 to the centre of a fourth disc 109.

The fourth disc rotates in the space between the lower frame member 30 and the mounting plate 94 for the second cover yarn package 92 and is driven at the same speed and in the same direction as the third disc 100 by a tooth drive wheel and belt assembly. FIG. 2*a* shows that the guide passage for the covered yarn 101 leads the covered yarn to the centre of the disc where it is wrapped together with the second cover yarn 106 as it is drawn off by draw rollers 87 to a take-up package 88 driven by a drive roller 90 in the manner described above.

The third and fourth discs 100, 109 can be rotated in the same direction as the first and second discs 38, 80 such that the direction of the helical winding of the first and second cover yarns is the same. However it is preferable that the third and fourth discs 100, 109 are rotated in the opposite direction to the first and second discs 38, 80 such that the second cover yarn is wrapped in the opposite direction of the first cover yarn.

Figure 3:
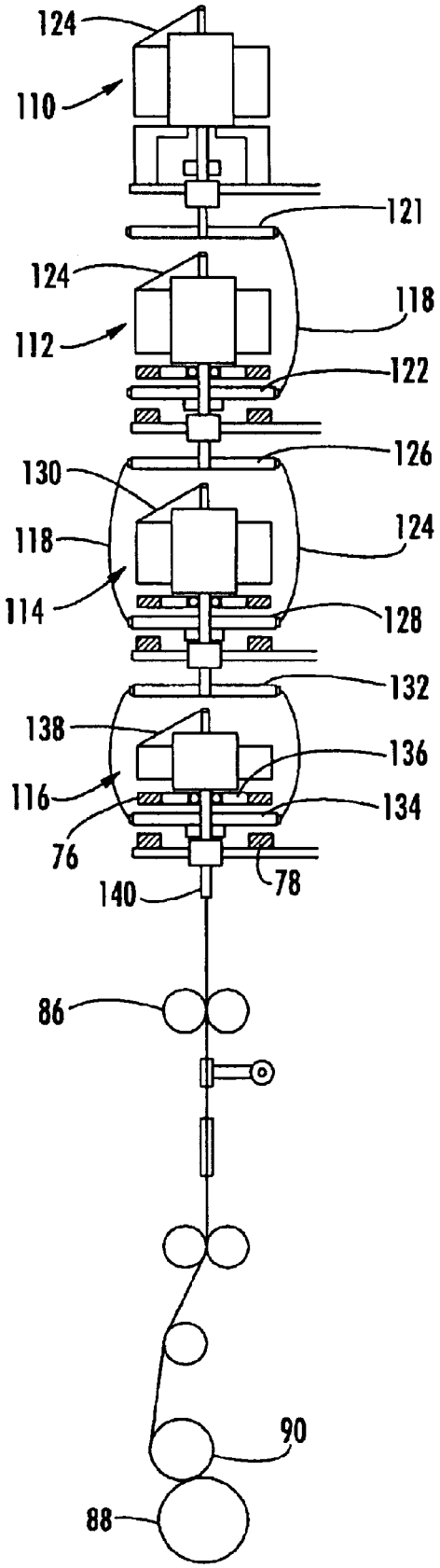
FIG. 3 shows diagrammatically an apparatus for providing a multi yarn covering on a core yarn.

FIG. 3 illustrates an apparatus for providing three cover yarns on a core yarn.

In general, its form and method of operation is similar to the form and method of operation described with reference to FIG. 1 and, as a result, a detailed description will not now be given, rather a general description will be given and reference can be made to FIG. 1 for detail.

In this embodiment, three cover yarn packages 110, 112 and 114 are arranged vertically one above the other and all vertically above the core yarn package 116. A first cover yarn 118 is taken, by way of first and second discs 121, 122 past the second cover package 112 which is fixed against rotation, in the manner described above, by magnetic means. The second cover yarn 124 is led through the centre of its package to a third disc 126 having two, diametrically opposed, radial passages and rotating at the same speed and direction as the second disc 122.

The first and second cover yarns 118 and 124 are guided past the third cover yarn package 114 to a fourth disc 128 having two, diametrically opposed radial passages therethrough. The third cove yarn 130 from the third cover yarn package 114 is led through the spindle at the middle of this package to a radially extending passage in the fifth disc 132 which is driven in the same direction and at the same speed as the fourth disc 128 and has three radial passages mutually arranged at 120° spacing. The three cover yarns (only two of which are shown in FIG. 3) are then supplied to three radial passages spaced at 120° in a fifth disc 134, passing the core yarn package 116 which is held against rotation in the normal manner on a mounting plate 136 by magnets 76 and 78. The core yarn 138 removed from its package 116, in a manner described with reference to FIG. 1, is then guided axially through the rotatable spindle 140 on which the sixth disc 134 is mounted and the three cover yarns are wrapped around the core yarn in a manner similar to that illustrated in FIG. 2*a*. The arrangement of draw rollers 86, a covered package 88 and package drive 90 are also as described above.

Various modifications can be made without departing from the scope of the invention, for example the mounting means of the various packages can be modified, provided that the packages are held against rotation as the yarn is drawn off from them. The discs and arrangement of guide means in them can be modified. Rather than having passages extending through the discs, yarn guide means could be mounted above and/or below the discs to guide yarn over the surface of the discs. A further guide passing through the disc near its periphery guides the yarn from the radial to the axial direction. The discs could be lightened by removing sections therefrom but it is important to ensure that the discs remain statically and dynamically balanced to ensure smooth operation of the apparatus. Directions of rotation can be amended giving different covering effects and by varying the tensions of the core yarn and the covering yarn or yarns, different effects can be achieved in the covered yarn. The discs can be made from reinforced synthetic resinous material.

Additional apparatus, which is standard in this art, can be employed between the draw rollers and the take-up package, for example, heaters to set the covered yarn, oiling rollers, air jet treatment apparatus. The arrangement of structural components, for example, bearings, yarn tensioners, yarn guides can be varied utilising alternatives known in the art.

It is possible, simply by altering the yarn guides within the discs, to arrange for the covering yarns to be applied to the core yarn at the same height or at differing heights.

The apparatus shown in FIG. 3 can be modified by adding or subtracting cover yarn package assemblies therefrom. If the lower cover yarn package assembly is removed a double covered core yarn will be obtained and if more cover yarn package assemblies are added between the lowermost cover yarn package assembly and the core yarn package assembly a multi covered core yarn will be obtained. Each additional cover package assembly will have discs with correspondingly extra passages.

It will be realised that the apparatus produces a package of covered yarn which is considerably longer than that produced by existing apparatus without the need to knot lengths of yarn together, re-spooling etc. It is possible for the present apparatus to ensure that there is no twist in the cover yarn. As the cover yarn is always guided through a pair of discs, any twist which is induced by one disc is removed by the other disc which, it will be recalled, is rotating in the same direction and at the same speed.

In general terms, the apparatus is more compact than existing apparatus even although the yarn packages that it can accommodate are of a much greater size than those used in existing apparatus.

As a result of the relatively close spacing of the discs and the control which can be exerted on the cover yarns, the discs can be made to rotate at a speed much greater than that normally encountered in apparatus of this nature.

What is claimed is:

1. A method of covering a core yarn with a cover yarn, the method including the steps of supplying a package of core yarn on a member which is fixed against rotation, supplying a package of cover yarn guiding the cover yarn to form a loop which on rotation about an axis defines an envelope which surrounds the core yarn package, drawing off core yarn along the axis of the envelope in the direction away from the cover yarn package so that when the core yarn intercepts the envelope it is covered by cover yarn, wherein the cover yarn is positively guided inwardly by a rotatable member over substantially the entire distance from or near to the periphery of the rotatable member to the centre of the rotatable member, such that cover yarn exiting from the rotatable member at its centre is wound around the core yarn from a direction generally perpendicular thereto.

2. A method according to claim 1, wherein a plurality of cover yarns are provided to form a multiple covering on the core yarn.

3. A method according to claim 2, wherein each cover yarn is taken from an independent supply of cover yarn.

4. A method according to claim 3, wherein the independent supplies of cover yarn are all arranged in sequence on one side of the core yarn supply.

5. A method according to claims 4, wherein the cover yarn from each supply is guided to form a loop which on rotation about an axis defines an envelope which surrounds the core yarn supply and all cover yarn supplies which are closer to the core yarn supply than the said cover yarn supply.

6. A method according to claim 5, wherein the loops are spaced from each other and rotated at the same speed and in the same direction.

7. A method according to claim 5, wherein all cover yarn envelopes are intercepted by the core yarn at the same point.

8. A method according to claim 5, wherein all cover yarn envelopes are intercepted by the core yarn at closely spaced points.

9. A method according to claim 5, wherein the loops which define all the envelopes are equally spaced angularly at the interception point.

10. An apparatus for covering a core yarn with a cover yarn, the apparatus including a package of core yarn on a member which is fixed against rotation, a package of cover yarn, and means for guiding the cover yarn to form a loop which on rotation about an axis defines an envelope which surrounds the core yarn package, and means for drawing off core yarn along the axis of the envelope in the direction away from the cover yarn package so that when the core yarn intercepts the envelope it is covered by the cover yarn, the apparatus including a rotatable member including guide means for positively guiding the cover yarn over substantially the entire distance from or near to the periphery of the rotatable member to the centre of the rotatable member, whereby cover yarn exiting from the rotatable member at its centre is wound around the core yarn from a direction generally perpendicular thereto.

11. Apparatus according to claim 10, wherein the apparatus includes a first rotatable member located on one side of the core yarn package and a second rotatable member located on the other side of the core yarn package, the rotatable members being axially spaced from the core yarn package, means for rotating the first and second rotatable members at the same speed and direction, a mounting for a package of cover yarn, take-off means for leading cover yarn from said cover yarn package to the centre of said first rotatable member, first guide means on the first rotatable member for guiding cover yarn from the centre to or near to the periphery of said first rotatable member, second guide means in the first rotatable member for leading cover yarn from the first rotatable member to or near to the periphery of the second rotatable member, guide means in the second rotatable member for guiding cover yarn from or near to the periphery of the second rotatable member to the centre of the said rotatable member, core yarn take-off means for leading core yarn through the second rotatable member along its axis of rotation whereby cover yarn exiting from the second rotatable member at its centre is wound around the core yarn, and means for drawing off covered yarn.

12. Apparatus according to claim 11, wherein the rotatable members are discs.

13. Apparatus according to claim 12, wherein a hollow member passes through the core yarn package through which core yarn from the package is guided to the centre of the second disc.

14. Apparatus according to claim 12, wherein the axis of the cover yarn package, the first and second disc and the core yarn package are coincident.

15. Apparatus according to claim 12, wherein a cylindrical enclosure is provided around a pair of co-operating discs and the core yarn package.

16. Apparatus according to claim 11, wherein the means for holding the core yarn packaging against rotation includes a magnet in the core yarn mounting and a magnet on a fixed member located on the side of the second disc opposite to said core yarn mounting.

17. Apparatus according to claim 10, wherein a yarn tensioner is provided for the core yarn.

18. Apparatus according to claim 17, wherein the tensioner comprises first and second annular discs mounted for axial movement over the surface of the hollow member, a spring for biasing discs towards the end of the hollow member and an annular member resting on the disc closest to the end of the member.

19. Apparatus according to claim 18, wherein the weight of the annular member is variable to vary tension on yarn passing between the discs prior to it passing through the spindle.

20. Apparatus according to claim 10, wherein one or more additional cover yarn packages are interposed between the said cover yarn package and the core yarn package.

21. Apparatus according to claim 20, wherein each of the interposed packages has a pair of discs, one on each side thereof.

22. Apparatus according to claim 21, wherein each disc is provided with cover yarn guide means for directing cover yarn from preceding package(s) from the centre to the periphery of the upper disc of the pair, from the periphery of the upper disc to the periphery of the lower disc, from the periphery of the lower disc to the centre thereof and thereafter to the centre of the next succeeding discs with all the discs being rotated at the same speed and in the same direction.

23. Apparatus according to claim 10, wherein the apparatus includes a further mounting for a package of second cover yarn, means for holding the further mounting against rotation, third and fourth discs located on each side of the said mounting and package, means to rotate the third and fourth discs at the same speed and in the same direction, means for leading covered yarn from an earlier covering apparatus to the centre of the third disc, guide means in the third disc for guiding covered yarn from the centre to or near to the periphery of the third disc, means at or near the periphery of the third disc for guiding covered yarn to a point at or near the periphery of the fourth disc, guide means in the fourth disc for guiding covered yarn from its periphery to its centre, and further guide means for guiding covered yarn through the centre of the fourth disc whereby the second cover yarn and the covered yarn are wound together and means for drawing off covered yarn.

* * * * *